United States Patent [19]

Diggins

[11] 4,421,069

[45] Dec. 20, 1983

[54] DESUPERHEATER SPRAY LINER ASSEMBLY

[75] Inventor: Joseph P. Diggins, Coraopolis, Pa.

[73] Assignee: Foster Wheeler Energy Corporation, Livingston, N.J.

[21] Appl. No.: 415,624

[22] Filed: Sep. 7, 1982

[51] Int. Cl.[3] ..... F22G 5/12

[52] U.S. Cl. ..... 122/487; 122/510; 261/DIG. 13; 261/116

[58] Field of Search ..... 122/510, 487, 31 R; 261/DIG. 13, 116

[56] References Cited

U.S. PATENT DOCUMENTS

| | | | |
|---|---|---|---|
| 1,787,790 | 1/1931 | Mastembrook | 261/DIG. 13 |
| 3,287,001 | 11/1966 | Harris | 261/DIG. 13 |
| 3,318,589 | 5/1967 | Herp, Jr. | 261/DIG. 13 |

FOREIGN PATENT DOCUMENTS

| | | | |
|---|---|---|---|
| 2337738 | 2/1975 | Fed. Rep. of Germany | 122/487 |

*Primary Examiner*—Edward G. Favors

*Attorney, Agent, or Firm*—Marvin A. Naigur; John E. Wilson; Martin Smolowitz

[57] ABSTRACT

A spray liner assembly supported in a pressurized desuperheater header of a steam boiler. The liner is cylindrical shaped and open at each end, and is attached and axially retained at one end to the cylindrical header inner wall by multiple adjustable brackets, and is slidably supported at the opposite end by similar brackets. The liner is also flexibly supported radially at dual points on opposite sides of the liner at an intermediate point along its length with each support using a captured metal ball, so as to provide a radial inward elastic loading to the liner and also permit longitudinal and radial expansion and contraction of the liner within the header.

15 Claims, 4 Drawing Figures

DESUPERHEATER SPRAY LINER ASSEMBLY

BACKGROUND OF THE INVENTION

This invention pertains to a desuperheater header spray liner assembly used in high pressure steam boilers, and pertains particularly to an improved multiple support arrangement for such spray liner within the header.

Desuperheater header spray liners are usually provided in the headers of steam boilers to avoid erosion of the walls of the high pressure retaining header caused by injecting water into the desuperheater header. Such spray liners are usually rigidly attached to the header at one end and allowed to slide at the other end due to thermal expansion, with supports having close clearances being provided at selected points along the liner. However, it has been found that such supports are not only expensive to install properly, but can experience wear due to relative movement of the liner in the header. This can cause the liner to wear and loosen, vibrate, and eventually fail due to fatigue. Such liner failures necessitate boiler shutdown and expensive outage and repairs. For this reason, improvements are greatly needed in such desuperheater spray liners, especially in their support arrangements and configuration to lessen or eliminate wear and also to minmize or avoid welding of dissimilar materials.

SUMMARY OF INVENTION

The present invention provides an improved spray liner assembly used in a desuperheater header of steam boilers. The cylindrical spray liner is axially retained within the header at its inlet end by at least three equally spaced brackets welded to the header inner wall, each bracket having an adjustable set screw for readily providing the desired clearances between the bracket and the liner. The cylindrical liner is slidably supported at its opposite end also by at least three equally spaced similarly adjustable brackets welded to the header inner wall. A spray nozzle is removably inserted radially into the header and spray liner through an opening in the liner at its inlet end.

The cylindrical spray liner is further supported within the header at an intermediate point along its length by at least two equally spaced self-adjusting radial supports which impart a radial inward elastic or spring loading to the liner. Each radial support has a captured movable ball for providing a rolling type contact between the header and the liner. The movable balls each contact the liner through a support plate attached to the liner outer wall surface, and provide for free longitudinal movement for the liner due to its thermal expansion in the header. The support plate outer surface is preferably curved in a concave shape so that as the cylindrical liner expands longitudinally its radial elastic loading is automatically increased. The support plate also distributes the radial loading of the liner by the dual set screws and rolling ball over a large area of the liner, and thereby avoids high localized stresses and resulting fatigue cracks in the liner. Because the liner is supported within the header at each end using brackets having adjustment screws to provide proper clearances, and is also supported at an intermediate point along its length by spring loading, such support arrangement avoids the need for direct welding to the liner.

DETAILED DESCRIPTION OF INVENTION

Figure 1:
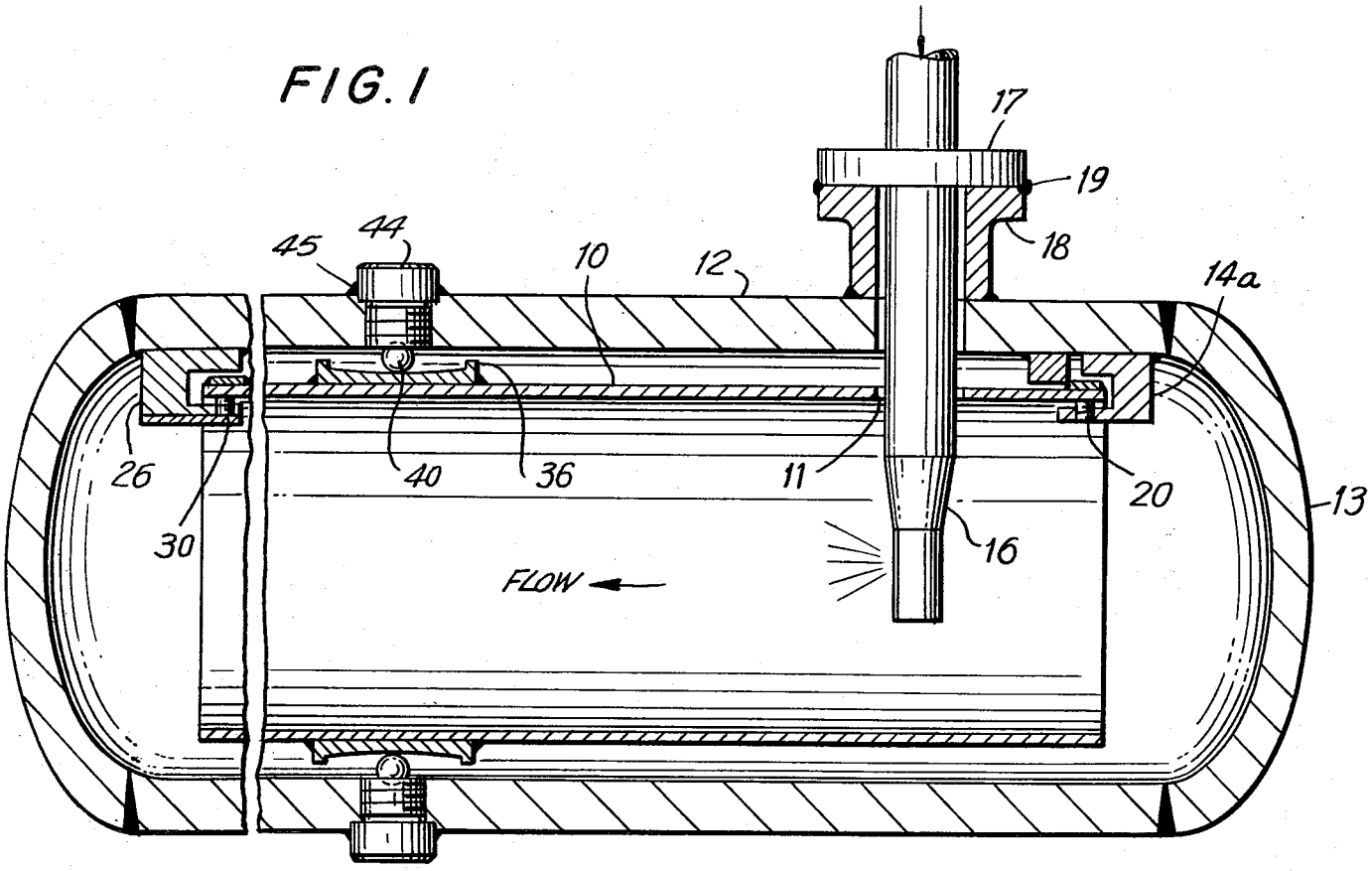
FIG. 1 is a longitudinal cross-sectional view of a steam boiler desuperheater header containing a spray liner assembly and spray nozzle in accordance with the invention.

The invention is generally shown by FIG. 1, in which a cylindrical-shaped metal spray liner 10 is provided centrally positioned within pressurizable desuperheater header 12 of a steam boiler, which is usually operated at pressure of 500–4000 psig. The liner is axially fixed in header 12 at its inlet end by at least three equally spaced support brackets 14*a*, 14*b*, and 14*c*. The outside diameter of liner 10 is sufficiently smaller than the header inside diameter to provide a radial clearance of at least about 0.5 inch, and such radial clearance usually need not exceed about 1 inch. A suitable material of construction for the liner 10 is alloy steel, and preferably austenitic stainless steel, such as AISI Type 304. The header 12 and welded heads 13 are made of a high strength alloy steel suitable for high temperature service.

Spray liner 10 has spray nozzle unit 16 inserted radially therein through an opening 11 and also through header 12 at the liner inlet end. Spray nozzle 16 is made removable from the header 12 and liner 10 by flange 17 being attached by bolts (not shown) to flange connection 18 welded to header 12. Flanges 17 and 18 can be preferably seal welded together at 19 to make the joint pressure tight.

Figure 2:
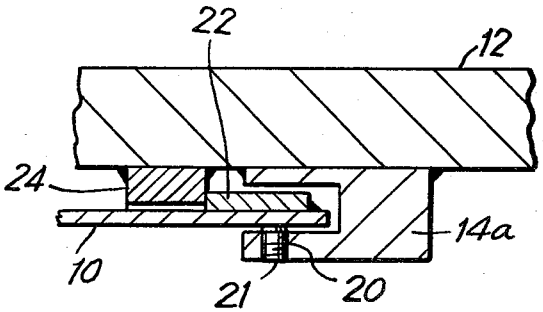
FIG. 2 is a longitudinal cross-sectional view showing an end support arrangement for the cylindrical liner within the header.

The attachment of liner 10 to header 12 is shown in greater detail in FIG. 2, in which cylindrical liner 10 is supported and axially retained at its inlet or nozzle end within header 12 by at least three brackets 14*a*, 14*b*, and 14*c*, which are circumferentially equally spaced and each contain an adjustable threaded set screw 20. A collar 22 is welded to the outer surface of liner 10 and is retained between the u-shaped brackets 14*a*, 14*b*, and 14*c* and a ring 24, which is welded to the inner surface of header 12. Set screws 20 are conveniently adjusted to provide the desired radial clearance between liner 10 and brackets 14, after which each set screw is fixed in place by spot welding at point 21.

Figure 3:
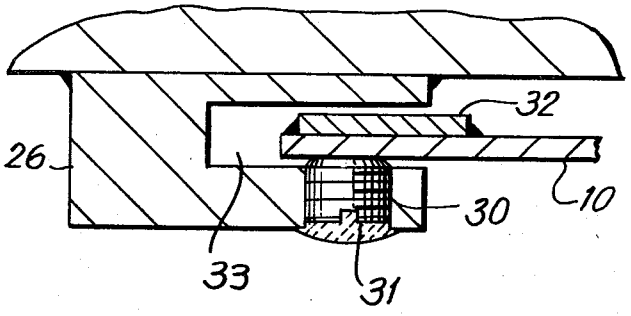
FIG. 3 is a longitudinal cross-sectional view of another end support arrangement for the opposite end of the liner within the header.

As shown in greater detail in FIG. 3, the opposite end of cylindrical liner 10 is slidably retained in at least three brackets 26*a*, 26*b*, and 26*c*, each also being provided with an adjustable threaded set screw 30. Liner 10 is provided with collar 32 welded to its outer surface. After adjustment of screw 30 for desired radial clearance between collar 32 and brackets 26, screw 30 is fixed in position by welding at point 31. Sufficient axial clearance is provided at 33 between the end of liner 10 and brackets 26 to permit liner 10 to expand longitudinally during heating to its operating temperature and to slide as needed within the brackets 26.

Figure 4:
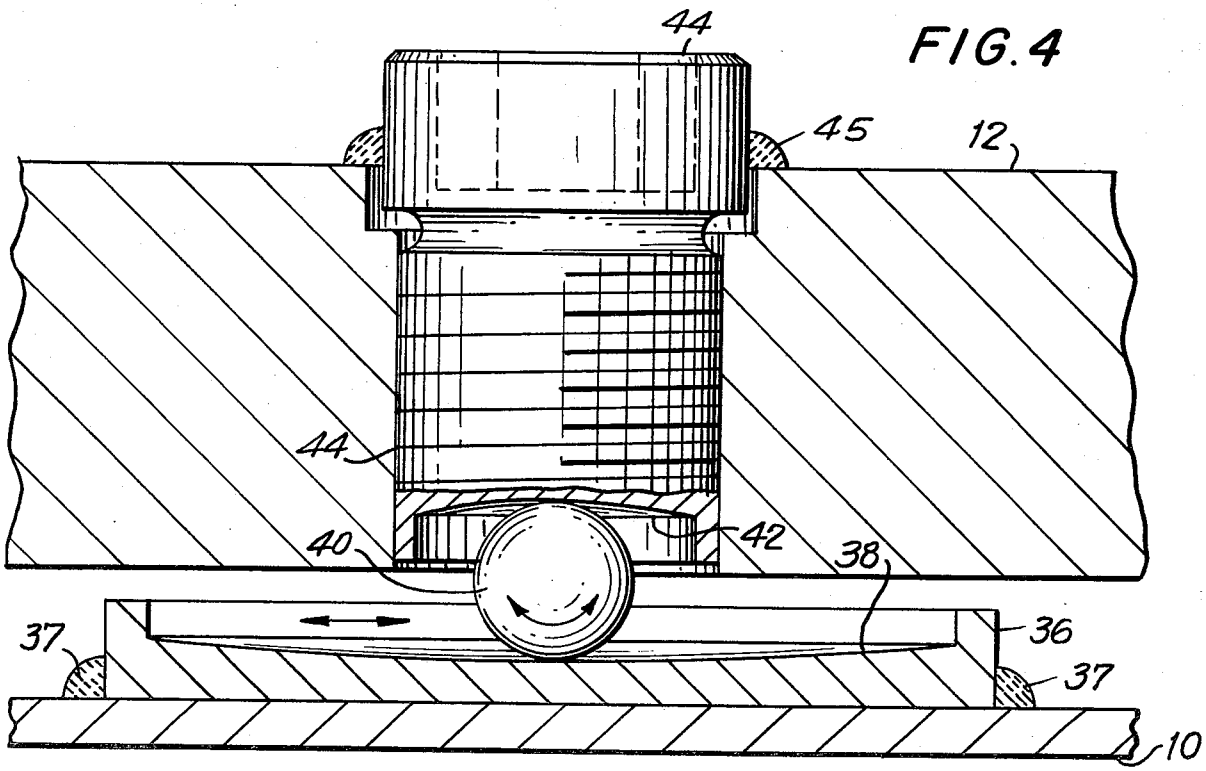
FIG. 4 is a cross-sectional view of a self-adjusting radial support device used at an intermediate point along the cylindrical spray liner.

Cylindrical liner 10 is further radially supported on opposite sides at an intermediate point near the middle of its length by at least two circumferentially equally-spaced support devices each providing radial inward elastic loading and a rolling support by using a captured metal ball 40, as shown in FIG. 4. Support plate 36 is rigidly attached to the outer surface of liner 10 as by welding at 37, and the plate preferably is provided with a concave curved outer surface 38. Ball 40 is captured between curved surface 38 and curved surface receptacle 42 provided in the inner end of set screw 44. The set screw 44 is threaded into header 12, and after proper adjustment can be sealed in place by circumferential seal weld 45.

By the support arrangement of this invention, the entire liner 10 is advantageously used as a cylindrical spring to retain it centrally positioned within the header 12 without vibration, and yet with necessary provision for both axial and diametral expansion of the liner when at elevated operating temperature, such as at 800°–1100° F. Support plate 36 also serves to distribute the radial load of set screw 44 applied through ball 40 against cylindrical liner 10 over a sufficiently large area to avoid high localized stresses and distortion of the liner. By providing curved surface 38, the elastic or spring loading by ball 40 is maintained or even increased as the liner expands longitudinally and radially relative to the header from ambient temperature to their normal elevated operating temperatures.

This invention will be further described by reference to the following example, which should not be construed as limiting in scope.

EXAMPLE

A typical spray liner assembly for use in a desuperheater header according to the invention is constructed having the following dimensional specifications:

Header length: 12 ft.
Header outside diameter: 19.25 in.
Header inside diameter: 13.875 in.
Liner length: 10 ft.
Liner outside diameter: 12.375 in.
Nominal radial clearance between header and liner: 0.750 in.
Nominal radial clearance between liner and end supports: 0.060–0.070 in.
Material of header: alloy steel Material of liner: Inconel The cylindrical shaped liner is installed into the cylindrical header from one end, and the set screws for the end supports are adjusted to provide the proper clearance for thermal expansion and axial movement of the liner. Next, the intermediate radial supports are adjusted to provide about 0.060–0.125 in. deflection of the liner, then the adjusting screws are seal welded in place. Next the heads are welded onto the header and the spray nozzle is inserted into the liner and fixed in place, then connected to a water supply.

Although this invention has been described broadly and in terms of preferred embodiments, it is understood that modifications and variations can be made thereto within the scope of the invention, which is defined by the following claims:

I claim:

1. A spray liner assembly supported within a pressurizable desuperheater header, comprising:

(a) A cylindrical-shaped metal liner attached and axially retained at one end to a header inner wall by multiple circumferentially spaced support means;

(b) multiple circumferentially spaced support means located at the opposite end of said cylindrical liner for slidably attaching the liner to said header inner wall; and (c) multiple radial support means located on opposite sides of said liner at an intermediate point along the length of the liner for providing an elastic inward loading to the liner.

2. The liner assembly of claim 1, wherein said liner is attached at each end to the header inner wall by at least three equally spaced support brackets, each bracket being equipped with an adjustable screw means for providing proper radial clearance between the support brackets and the liner.

3. The liner assembly of claim 1, wherein said intermediate radial support means are located at opposite positions near the middle of the liner length.

4. The liner assembly of claim 3, wherein said radial support means includes a metal ball captured between an adjustable screw threaded into the header wall and a receptacle support plate attached to the liner outer surface.

5. The liner assembly of claim 4, wherein said receptacle plate has a concave curved outer surface so that as the liner expands, the radial inward loading on the liner is increased.

6. The liner assembly of claim 1, wherein the liner operating temperature is 800°–1100° F.

7. The liner assembly of claim 1, wherein the liner material is austenitic stainless steel.

8. A spray liner assembly supported within a pressurizable desuperheater header, comprising:

(a) a cylindrical-shaped metal liner attached and axially retained at one end to a header inner wall by three circumferentially equally-spaced support brackets each equipped with an adjustable set screw means;

(b) three circumferentially equally-spaced support means located at the opposite end of said cylindrical liner for slidably attaching the liner to said header inner wall; and (c) dual radial support means located on opposite sides of said liner and including a metal ball captured between an adjustable screw threaded into the header wall, and a receptacle support plate attached to the liner, said radial support located at an intermediate point along the external side of said liner for providing an elastic inward loading to the liner.

9. A desuperheater header and spray liner assembly for use in a steam boiler, comprising:

(a) a cylindrical-shaped metal pressurizable header;

(b) a cylindrical-shaped metal liner installed within said header and axially retained at one end to the header inner wall and slidably supported at its opposite end from the header inner wall; and (c) dual radial support means located on opposite sides of said liner at an intermediate point along the length of the liner for providing radial inward elastic loading to the liner.

10. The desuperheater header and spray liner assembly of claim 9, wherein said liner is attached at each end to the header inner wall by at least three equally spaced support brackets, each support bracket being equipped with an adjustable screw means for providing proper radial clearance between the support brackets and the liner.

11. The desuperheater header and spray liner assembly of claim 9, wherein said dual radial support means include a metal ball captured between an adjustable screw threaded into the header wall and a receptacle support plate attached to the liner outer surface.

12. The desuperheater header and spray liner assembly of claim 11, wherein said receptacle plate has a concave curved outer surface, so that as the liner expands the radial inward elastic loading on the liner is increased.

13. The desuperheater header and spray liner assembly of claim 11, wherein the liner operating temperature is 800°–1100° F.

14. The desuperheater header and liner assembly of claim 9, inclusive a spray nozzle means removably inserted radially through said header and through an opening at the inlet end of said liner for spraying pressurized water into said liner.

15. A desuperheater header and spray liner assembly for use in a steam boiler, comprising:

(a) a cylindrical-shaped metal pressurizable header of a steam boiler;

(b) a cylindrical-shaped metal liner installed within said header and axially retained at one end to the header inner wall and slidably supported at its opposite end from the header inner wall;

(c) dual radial support means located on opposite sides of said liner at an intermediate point along the length of the liner for providing radial inward elastic loading to the liner; and (d) a spray nozzle means extending radially through said header and through an opening at the inlet end of said liner for spraying pressurized water into said liner.

* * * * *